US008897473B2

(12) United States Patent
Fukuoka et al.

(10) Patent No.: US 8,897,473 B2
(45) Date of Patent: Nov. 25, 2014

(54) ACOUSTIC GENERATOR

(75) Inventors: Shuichi Fukuoka, Kirishima (JP); Noriyuki Kushima, Kirishima (JP); Hiroyuki Kawamura, Kirishima (JP); Hiroshi Ninomiya, Kirishima (JP)

(73) Assignee: Kyocera Corporation, Kyoto (JP)

( * ) Notice: Subject to any disclaimer, the term of this patent is extended or adjusted under 35 U.S.C. 154(b) by 9 days.

(21) Appl. No.: 13/805,615

(22) PCT Filed: Mar. 30, 2011

(86) PCT No.: PCT/JP2011/058035
§ 371 (c)(1), (2), (4) Date: Dec. 19, 2012

(87) PCT Pub. No.: WO2011/162002
PCT Pub. Date: Dec. 29, 2011

(65) Prior Publication Data

US 2013/0094681 A1 Apr. 18, 2013

(30) Foreign Application Priority Data

Jun. 25, 2010 (JP) ..... 2010-145243
Jul. 29, 2010 (JP) ..... 2010-170750
Oct. 26, 2010 (JP) ..... 2010-239794
Oct. 27, 2010 (JP) ..... 2010-240990

(51) Int. Cl.
*H04R 25/00* (2006.01)

(52) U.S. Cl.
USPC ..... 381/190; 381/173

(58) Field of Classification Search
CPC ..... H04R 25/00; H04R 2440/00–2440/07; H04R 2217/00–2217/03; H04R 19/00; H04R 19/01; H04R 19/013; H04R 19/016; H04R 17/02; H04R 19/04
USPC ..... 381/152, 190–191, 173–174, 431; 310/311, 324
See application file for complete search history.

(56) References Cited

U.S. PATENT DOCUMENTS 4,401,857 A * 8/1983 Morikawa ..... 381/182
4,969,197 A * 11/1990 Takaya ..... 381/190

(Continued)

FOREIGN PATENT DOCUMENTS

FR 2755242 A1 4/1998
JP S57128299 U 8/1982

(Continued)

OTHER PUBLICATIONS

Korean language office action dated Jan. 2, 2014 and its English language Statement of Relevance of Non-English References Pursuant to 37 CFR 1.98(a)(3)(i) issued in corresponding Korean application 1020127032476.

(Continued)

*Primary Examiner* — Suhan Ni
(74) *Attorney, Agent, or Firm* — DLA Piper LLP (US)

(57) ABSTRACT

Provided is an acoustic generator which has a high sound pressure at ultrahigh frequencies and which can suppress occurrence of large peak dips. An acoustic generator includes a film, a frame member disposed on an outer peripheral edge of the film, a piezoelectric element disposed on the film and inside the frame member, and a resin layer filled inside the frame member so as to cover the piezoelectric element.

13 Claims, 9 Drawing Sheets

(56) References Cited

U.S. PATENT DOCUMENTS

| | | | | |
|---|---|---|---|---|
| 4,985,926 | A * | 1/1991 | Foster | 381/77 |
| 5,761,156 | A | 6/1998 | Reuter et al. | |
| 6,278,790 | B1 * | 8/2001 | Davis et al. | 381/398 |
| 6,453,050 | B1 | 9/2002 | Ogura et al. | |
| 6,819,769 | B1 * | 11/2004 | Zimmermann | 381/152 |
| 2008/0018203 | A1 | 1/2008 | Fujiwara et al. | |
| 2008/0232608 | A1 | 9/2008 | Ullman | 381/77 |

FOREIGN PATENT DOCUMENTS

| | | | |
|---|---|---|---|
| JP | 62-064097 | | 4/1987 |
| JP | 02-288799 | | 11/1990 |
| JP | H03224400 | A | 10/1991 |
| JP | H05183994 | A | 7/1993 |
| JP | H06070397 | A | 3/1994 |
| JP | H09182189 | A | 7/1997 |
| JP | 2000114912 | A | 4/2000 |
| JP | 2001-128292 | | 5/2001 |
| JP | 2001-217473 | | 8/2001 |
| JP | 2003-304594 | | 10/2003 |
| JP | 2005-311415 | | 11/2005 |
| JP | 2007-520141 | | 7/2007 |
| JP | 2008028593 | A | 2/2008 |
| JP | 2009159350 | A | 7/2009 |
| JP | 2010-103977 | | 5/2010 |
| WO | 2006025138 | A1 | 3/2006 |

OTHER PUBLICATIONS

"Metaperceptive Sound World and Brain—Invitation to the Hypersonic Effect", Trans. Tech. Comm, Phychol. Physiol. Acoustic the Acoustical Society of Japan, vol. 36, No. A, H-2006-A2, Aug. 2, 2006.

Extended European search report dated Apr. 14, 2014 issued in corresponding European application 11797890.8 cites the U.S. patent and foreign patent documents listed above.

Japanese language office action dated May 7, 2014 and its English language statement of relevance of non-English references pursuant to 37 CFR 1.98(a)(3)(i) cites the foreign patent documents listed above.

* cited by examiner

ACOUSTIC GENERATOR

TECHNICAL FIELD

The present invention relates to an acoustic generator, and more particularly, to an acoustic generator using a multilayer piezoelectric element.

BACKGROUND ART

Recently, to cope with high-quality and ultrabroadband sources such as DVD audio or super audio CDs, speakers capable of reproducing the sound up to ultrahigh frequencies of more than or equal to 100 KHz have been requested. There is also a need for high-pitched speakers capable of reproducing the sound up to ultrahigh frequencies at low cost, without regard to being a single components or small-sized stereo.

Conventionally, a high-pitched speaker in which a vibration diaphragm is driven using a piezoelectric element is suggested. However, since an acoustic generator using a piezoelectric element generally uses a resonance phenomenon, it is known that large peak dips occurred in frequency characteristics of the sound pressure and it is difficult to achieve satisfactory sound pressures up to ultrahigh frequencies.

Therefore, as a method for improving the peak dips in frequency characteristics in an acoustic generator using a piezoelectric element as a drive source, an acoustic generator disclosed in Patent Literature 1 is known.

The acoustic generator disclosed in Patent Literature 1 includes two disk-like piezoelectric elements disposed in two circular metal bases, respectively, and a single vibration diaphragm disposed to cover the two piezoelectric elements with a predetermined gap from the piezoelectric elements. The vibration diaphragm has a rectangular shape in a plan view which is convex in a direction in which sound is emitted. In such an acoustic generator, it is described that a high sound pressure is achieved up to about 100 KHz.

For example, according to Non Patent Literature 1, it is proven that the sound of ultrahigh frequency components of more than 20 KHz activates the human brain stem to have a good influence on a human being, such as an improvement in immune activity, a decrease in stress hormones, an enhancement of a waves in the brain, and making the sound of an audible frequency band of 20 KHz or lower more audible. The importance of an ultrahigh-frequency sound is becoming higher.

CITATION LIST

Patent Literature

Patent Literature 1: Japanese Unexamined Patent Publication JP-A 2003-304594

Non Patent Literature

Non Patent Literature 1: "Metaperceptive Sound World and Brain—Invitation to the Hypersonic Effect—", Trans. Tech. Comm. Psychol. Physiol. Acoust., The Acoustical Society of Japan, Vol. 36, No. A, H-2006-A2, Aug. 2, 2006

SUMMARY OF INVENTION

Technical Problem

However, in the acoustic generator disclosed in Patent Literature 1, since vibration of the piezoelectric element is transmitted to the vibration diaphragm covering the piezoelectric element with a predetermined gap therebetween via the metal base and is radiated to the outside from the vibration diaphragm, there is a problem in that the sound pressure is still low at ultrahigh frequencies of more than 100 KHz and large peak dips occur.

An object of the invention is to provide an acoustic generator which has a high sound pressure at ultrahigh frequencies and which can suppress occurrence of large peak dips.

Solution to Problem

The invention provides an acoustic generator including: a film; a frame member disposed on an outer peripheral edge of the film; a piezoelectric element disposed on the film and inside the frame member; and a resin layer filled inside the frame member so as to cover the piezoelectric element.

Advantageous Effects of Invention

In the acoustic generator according to the invention, it is possible to raise the sound pressure at ultrahigh frequencies of more than 100 KHz and to reduce occurrence of large peak dips.

DESCRIPTION OF EMBODIMENTS

Figure 1:
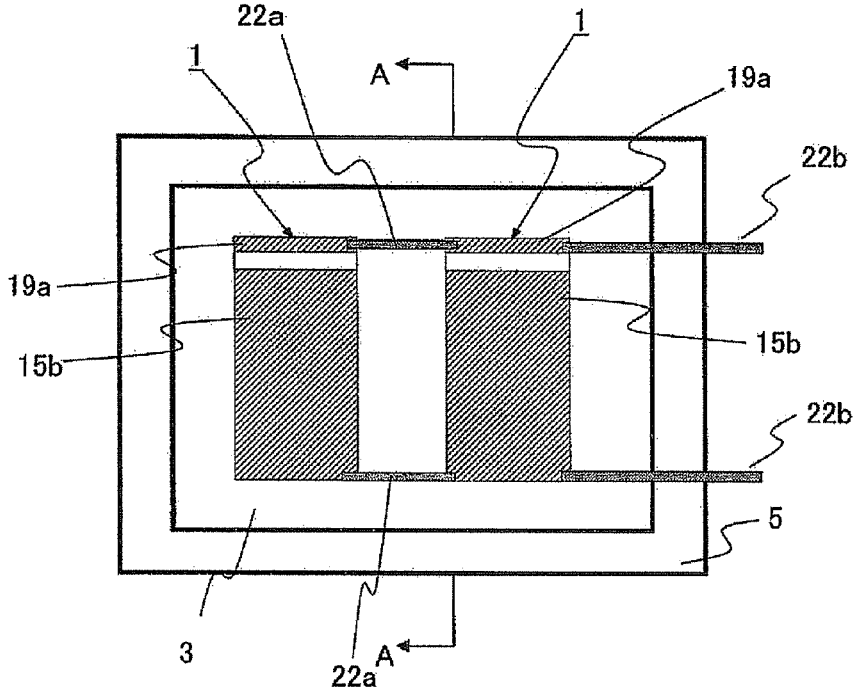
FIG. 1 is a plan view illustrating an acoustic generator according to a first embodiment in which two unimorph type multilayer piezoelectric elements are disposed on each of top and bottom surfaces of a resin sheet to be opposite to each other.

Hereinafter, an acoustic generator according to a first embodiment of the invention will be described with reference to FIGS. 1 and 2. The acoustic generator shown in FIGS. 1 and 2 includes multilayer piezoelectric elements 1 as two piezoelectric elements disposed on each of top and bottom surfaces of a film 3 serving as a support diaphragm which is sandwiched between a pair of frame-like frame members 5.

That is, in the acoustic generator according to the first embodiment, the film 3 is sandwiched between first and second frame members 5*a* and 5*b* in a state where tension is applied to the film 3, the film 3 is fixed to the first and second frame members 5*a* and 5*b*, and two multilayer piezoelectric elements 1 are disposed on each of the top and bottom surfaces of the film 3.

Two multilayer piezoelectric elements 1 disposed on the top and bottom surfaces of the film 3 be opposite to each other to sandwich the film 3 therebetween and are configured so that when one multilayer piezoelectric element 1 contracts, the other opposed multilayer piezoelectric element 1 expands.

In the cross-sectional views (FIGS. 2, 3, 4, and 5) of the acoustic generator, a thickness direction y of the multilayer piezoelectric element 1 is enlarged for the purpose of facilitating understanding thereof.

The multilayer piezoelectric element 1 includes a stacked body 13 in which four piezoelectric layers 7 formed of ceramics and three internal electrode layers 9 are alternately stacked, surface electrode layers 15*a* and 15*b* disposed on the top and bottom surfaces of the stacked body 13, and a pair of external electrodes 17 and 19 disposed at both ends in a length direction x of the stacked body 13.

The external electrode layer 17 is connected to the surface electrode layers 15*a* and 15*b* and one internal electrode layer 9, and the external electrode layer 19 is connected to two internal electrode layers 9. The piezoelectric layers 7 are polarized alternately in the thickness direction of the piezoelectric layers 7 as indicated by an arrow in FIG. 2. The external electrode layers 17 and 19 are supplied with a voltage so that when the piezoelectric layer 7*s* of the multilayer piezoelectric element 1 on the top surface of the film 3 contracts, the piezoelectric layers 7 of the multilayer piezoelectric element 1 on the bottom surface of the film 3 expand.

Bent external electrodes 19*a* extending to the top and bottom surfaces of the stacked body 13 are disposed on top and bottom end faces of the external electrode layer 19. The bent external electrodes 19*a* extend with a predetermined $ga_p$ from the surface electrode layers 15*a* and 15*b* so as not to come in contact with the surface electrode layers 15*a* and 15*b* disposed on a surface of the stacked body 13.

A lead terminal 22*a* extends over the bent external electrode 19*a* on the surface of the stacked body 13 opposite to the film 3, one end of a lead terminal 22*b* is connected to one bent external electrode 19*a* to which the lead terminal 22*a* is connected, and the other end thereof extends to the outside. The lead terminal 22*a* extends over the surface electrode 15*b* connected to the external electrode 17, one end of the lead terminal 22*b* is connected to one surface electrode 15*b* to which the lead terminal 22*a* is connected, and the other end thereof extends to the outside.

Therefore, a plurality of multilayer piezoelectric elements 1 are connected to each other in parallel and are supplied with the same voltage via the lead terminals 22*a* and 22*b*.

The multilayer piezoelectric element 1 has a plate shape, has the top and bottom main surfaces of a rectangular shape, and has a pair of side faces from which the internal electrode layers 9 are alternately drawn out in the length direction x of the main surfaces of the stacked body 13.

The four piezoelectric layers 7 and the three internal electrode layers 9 are co-fired in a stacked state. The surface electrode layers 15*a* and 15*b* are formed by applying a paste to the formed stacked body 13 and baking the paste, as described later.

The main surface of the multilayer piezoelectric element 1 facing the film 3 is bonded to the film 3 with an adhesive layer 21. The thickness of the adhesive layer 21 between the multilayer piezoelectric element 1 and the film 3 is set to be equal to or less than 20 μm. Particularly, the thickness of the adhesive layer 21 is preferably equal to or less than 10 μm. In this way, when the thickness of the adhesive layer 21 is equal to or less than 20 μm, the vibration of the stacked body 13 can be easily transmitted to the film 3.

Known adhesives such as epoxy-based resins, silicon-based resins, and polyester-based resins can be used as the adhesive constituting the adhesive layer 21. Even when any of a thermosetting method, a photo-curing method, and an anaerobic method is used as the curing method of the resin used for the adhesive, a vibrator can be produced.

Regarding the piezoelectric characteristics of the multilayer piezoelectric element 1, it is preferable that the piezoelectric d31 constant is equal to or more than 180 μm/V, in order to induce large deflection flexural vibration to enhance the sound pressure. When the piezoelectric d31 constant is equal to or more than 180 pm/V, the average sound pressure in a range of 60 KHz to 130 KHz can be equal to or more than 65 dB.

Figure 6:
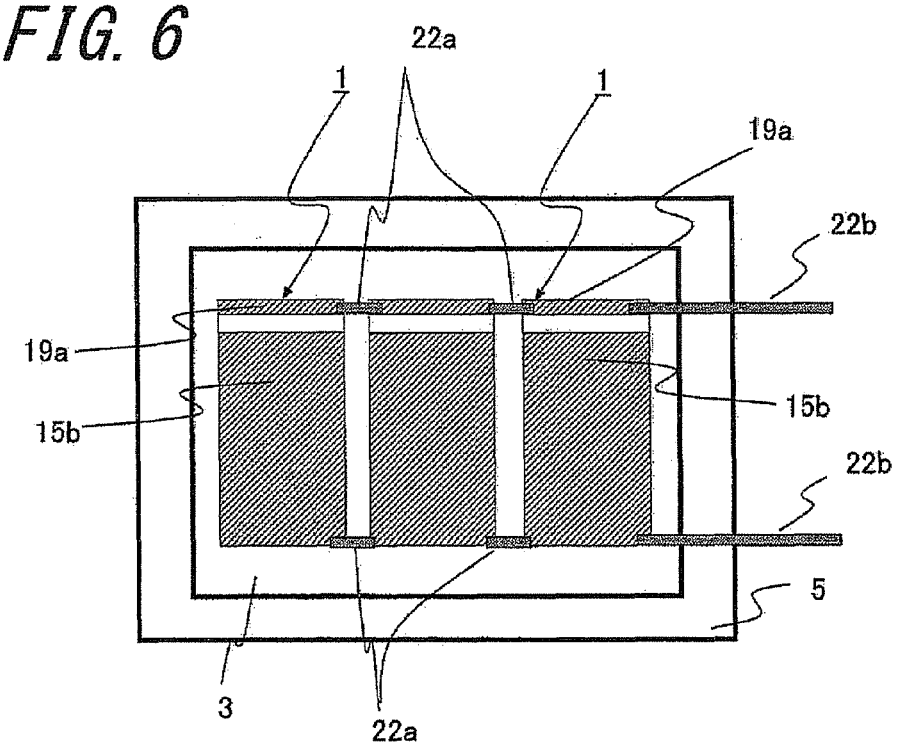
FIG. 6 is a plan view illustrating an acoustic generator according to a fifth embodiment in which three unimorph type multilayer piezoelectric elements are disposed on each of top and bottom surfaces of the film to be opposite to each other.
Figure 7:
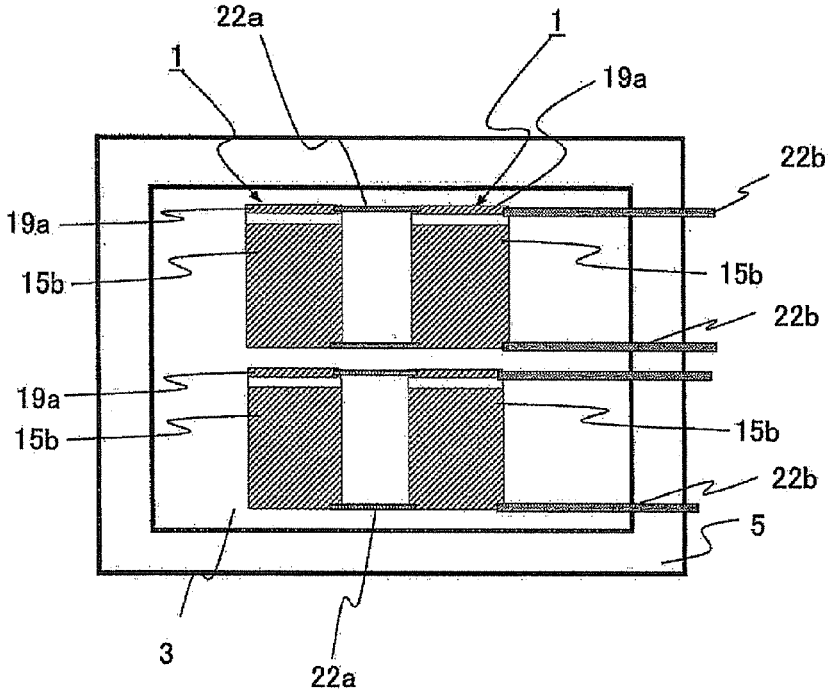
FIG. 7 is a plan view illustrating an acoustic generator according to a sixth embodiment in which four unimorph type multilayer piezoelectric elements are disposed on each of top and bottom surfaces of the film to be opposite to each other.

In the acoustic generator according to the first embodiment, the insides of the frame members 5*a* and 5*b* are filled with a resin so as to embed the multilayer piezoelectric element 1, thereby forming a resin layer 20. Parts of the lead terminal 22*a* and the lead terminal 22*b* are embedded in the resin layer 20. In FIG. 1 and FIGS. 6 and 7 described later, the resin layer 20 is not shown for the purpose of facilitating understanding.

This resin layer 20 can be formed of, for example, an acryl-based resin, a silicon-based resin, or rubber. The material thereof preferably has a Young's modulus in a range of 1 MPa to 1 GPa and more preferably in a range of 1 MPa to 850 MPa. The thickness of the resin layer 20 needs to be set to completely cover the multilayer piezoelectric element 1, from the viewpoint of suppressing a spurious emission. Since the film 3 serving as a support diaphragm vibrates as a unified body with the multilayer piezoelectric element 1, the region of the film 3 not covered with the multilayer piezoelectric element 1 is similarly covered with the resin layer 20.

Since the acoustic generator includes the film 3, two multilayer piezoelectric elements 1 disposed on each of the top and bottom surfaces of the film 3, and the resin layer 20 disposed inside the frame member 5 so as to embed the multilayer piezoelectric elements 1, the multilayer piezoelectric elements 1 can induce deflection flexural vibration of a wavelength corresponding to a high-frequency sound and reproduce the sound of an ultrahigh frequency component of more than or equal to 100 KHz.

By embedding the multilayer piezoelectric elements 1 in the resin layer 20, a peak dip resulting from a resonance phenomenon of the multilayer piezoelectric element 1 causes an appropriate damping effect, thereby suppressing the resonance phenomenon, suppressing the peak dip so as to be small, and reducing the frequency dependency of a sound pressure.

By disposing the plurality of multilayer piezoelectric elements 1 on one film and applying the same voltage to the plurality of multilayer piezoelectric elements 1, strong vibration is suppressed by mutual interference of vibrations caused in the respective multilayer piezoelectric elements 1 and the vibrations are distributed, thereby causing a decrease in peak dip. As a result, it is possible to raise the sound pressure even at an ultrahigh frequency of more than 100 KHz.

Other piezoelectric ceramics, which have been conventionally used, such as lead zirconate (PZ), lead zirconate titanate (PZT), and non-lead piezoelectric materials such as Bi layered compound and tungsten bronze structure compound can be used for the piezoelectric layer 7. The thickness of a single piezoelectric layer 7 is set to a range of 10 to 100 μm, from the viewpoint of driving with a low voltage.

The internal electrode layer 9 preferably contains a metal component composed of silver and palladium and a material component constituting the piezoelectric layer 7. By including the ceramic component constituting the piezoelectric layer 7 in the internal electrode layer 9, it is possible to reduce stress due to a difference in thermal expansion between the piezoelectric layer 7 and the internal electrode layer 9 and to obtain a multilayer piezoelectric element 1 without lamination failure. The internal electrode layer 9 is not limited to the metal component composed of silver and palladium, and the ceramic component thereof is not also limited to the material component constituting the piezoelectric element layer 7, but may employ other ceramic components.

The surface electrode layer 15 and the external electrode layers 17 and 19 preferably include a glass component in addition to a metal component composed of silver. By including the glass component, it is possible to obtain a strong adhesive force between the piezoelectric layer 7 or the internal electrode layer 9 and the surface electrode layer 15 or the external electrodes 17 and 19.

The outer shape of the multilayer piezoelectric element 1 when seen from the stacking direction may be polygonal shapes such as a square shape and a rectangular shape.

The frame member 5 has a rectangular shape as shown in FIG. 1 and includes two rectangular frame members 5*a* and 5*b* bonded to each other. The outer peripheral edge of the film 3 is sandwiched between the frame members 5*a* and 5*b* and is fixed with tension applied thereto. The frame members 5*a* and 5*b* are formed of, for example, stainless steel with a thickness of 100 to 1000 μm. The materials of the frame members 5*a* and 5*b* are not limited to stainless steel, as long as it is less deformable than the resin layer 20. Examples thereof include hard resins, plastics; engineering plastics, and ceramics. In this embodiment, the material, the thickness, and the like of the frame members 5*a* and 5*b* are not particularly limited. The frame shape is not limited to the rectangular shape, but may be a circular shape or a diamond shape.

The film 3 is fixed to the frame members 5*a* and 5*b* in a state where tension in the in-plane direction is applied to the film 3 by sandwiching the outer peripheral edge of the film 3 between the frame members 5*a* and 5*b*. The film 3 serves as a vibration diaphragm. The thickness of the film 3 is, for example, in a range of 10 to 200 μm. The film 3 is formed of, for example, resins such as polyethylene, polyimide, polypropylene, and polystyrene, or paper formed of pulp or fiber. By using these materials, it is possible to suppress the peak dip.

A method of manufacturing the acoustic generator according to the invention will be described below.

First, multilayer piezoelectric elements 1 are prepared. For each multilayer piezoelectric element 1, a binder, a dispersant, a plasticizer, and a solvent are kneaded with powder of a piezoelectric material to form slurry. Any of lead-based materials and non-lead-based materials can be used as the piezoelectric material.

The resultant slurry is molded in a sheet to obtain a green sheet, and an internal electrode paste is printed on the green sheet to form an internal electrode pattern. Three green sheets having the electrode pattern formed thereon are stacked and only a green sheet is stacked as the uppermost layer to form a laminated molded body.

Then, the laminated molded body is degreased, fired, and cut in a predetermined size, whereby a stacked body 13 can be obtained. The outer peripheral edge of the stacked body 13 is processed if necessary, paste of the surface electrode layers 15*a* and 15*b* is printed on the main surface in the stacking direction of the piezoelectric layers 7 of the stacked body 13, paste of the external electrode layers 17 and 19 is printed on both side faces in the length direction x of the stacked body 13, and the electrodes are backed at a predetermined temperature, whereby the multilayer piezoelectric element 1 shown in FIG. 2 can be obtained.

Then, by applying a DC voltage to the multilayer piezoelectric element 1 via the surface electrode layer 15*b* or the external electrodes 17 and 19 to give piezoelectric characteristics to the multilayer piezoelectric element 1, the piezoelectric layers 7 of the multilayer piezoelectric element 1 are polarized. Application of a DC voltage is performed so that the polarization occurs in a direction indicated by an arrow in FIG. 2.

A film 3 serving as a support diaphragm is prepared, and the outer peripheral edge of the film 3 is sandwiched between the frame members 5*a* and 5*b* and is fixed with tension applied to the film 3. Thereafter, an adhesive is applied to both surfaces of the film 3, the multilayer piezoelectric elements 1 are pressed against both surfaces so as to sandwich the film 3 therebetween, and then the adhesive is cured by applying heat or ultraviolet rays thereto. Then, by causing a resin to flow in the frame members 5*a* and 5*b*, completely embedding the multilayer piezoelectric elements 1, and curing the resin layer 20, it is possible to obtain an acoustic generator according to the first embodiment.

The acoustic generator manufactured in this way has a simple structure, can achieve a decrease in size or thickness, and can maintain a high sound pressure up to an ultrahigh frequency. Since the multilayer piezoelectric elements 1 are embedded with the resin layer 20, they are hard to be affected by water or the like, thereby improving reliability.

Figure 3:
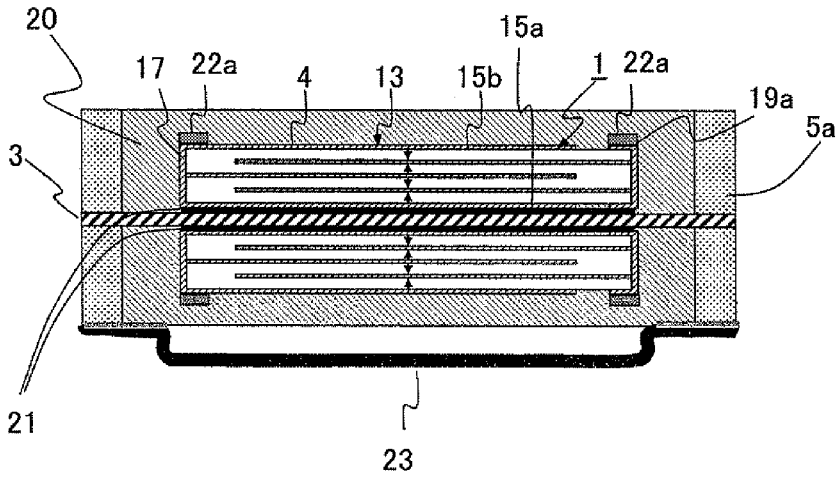
FIG. 3 is a longitudinal cross-sectional view illustrating an acoustic generator according to a second embodiment in which a case is disposed on the bottom surface of the acoustic generator shown in FIG. 2.

FIG. 3 is a diagram illustrating an acoustic generator according to a second embodiment. Here, the opposite surface of the acoustic generator emitting the sound is covered with a case 23 not vibrating even with the vibration of the multilayer piezoelectric elements 1. This case 23 has a structure in which a portion corresponding to the multilayer piezoelectric element 1 is swelled outward, and the outer peripheral edge of the case 23 is bonded to the frame member 5 and the resin layer 20 in the vicinity thereof.

In the acoustic generator in which the multilayer piezoelectric elements 1 are disposed on both sides of the film 3, since the sound emitted from the front surface thereof is opposite in phase to the sound emitted from the rear surface, the sounds are cancelled to deteriorate the sound quality or the sound pressure. However, in the second embodiment, since the case 23 is mounted on the rear surface of the piezoelectric speaker, it is possible to effectively emit the sound from the surface of the piezoelectric speaker, thereby improving the sound quality or the sound pressure.

Figure 2:
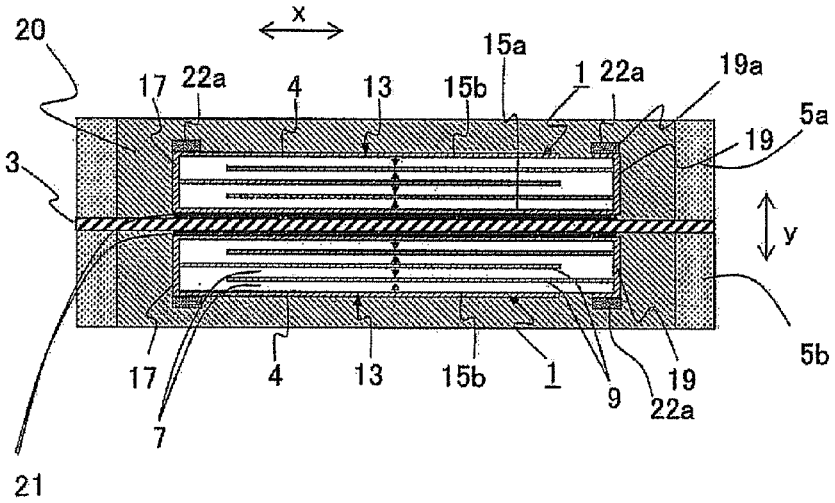
FIG. 2 is a longitudinal cross-sectional view taken along the line A-A of FIG. 1.

In the piezoelectric speakers shown in FIGS. 2 and 3, the number of piezoelectric layers 7 stacked in the multilayer piezoelectric element 1 is set to four, but the number of piezoelectric layers 7 stacked in the multilayer piezoelectric element 1 is not particularly limited, and may be, for example, two or more than four. The number of piezoelectric layers stacked is preferably equal to or less than 20, from the viewpoint of enlarging the vibration of the multilayer piezoelectric element 1.

Figure 4:
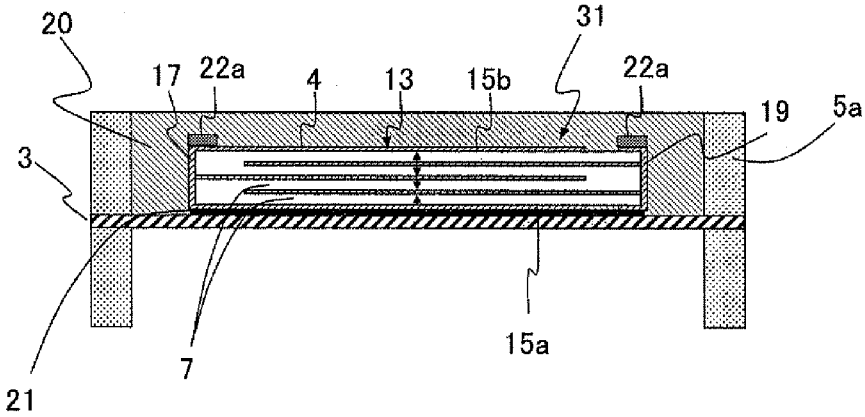
FIG. 4 is a longitudinal cross-sectional view illustrating an acoustic generator according to a third embodiment in which a bimorph type multilayer piezoelectric element is disposed on the top surface of a film.

FIG. 4 is a diagram illustrating an acoustic generator according to a third embodiment. In the third embodiment, the multilayer piezoelectric element 1 is bonded to only the top surface of the film 3 with the adhesive 21, and the multilayer piezoelectric element 1 is embedded with the resin layer 20.

The multilayer piezoelectric element 31 shown in FIG. 4 is a bimorph type multilayer piezoelectric element 31. That is, the bimorph type multilayer piezoelectric element has the same structure as the multilayer piezoelectric elements 1 shown in FIGS. 2 and 3, the polarization direction of the third and fourth piezoelectric layers 7 from the film 3 is reversed, so that the third and fourth piezoelectric layers 7 from the film 3 expand when the first and second piezoelectric layers 7 from the film 3 contract and the third and fourth piezoelectric layers 7 from the film 3 contract when the first and second piezoelectric layers 7 expand. The multilayer piezoelectric element 31 itself causes deflection flexural vibration, and this vibration cause the surface of the resin layer 20 to vibrate.

In such an acoustic generator, similarly to the first and second embodiments, since the deflection flexural vibration corresponding to a high-frequency sound can be induced in the bimorph type multilayer piezoelectric element 31, it is possible to obtain a high sound pressure up to ultrahigh frequencies and to simplify the structure, by only bonding the multilayer piezoelectric element 31 to only one side of the film 3.

Figure 5:
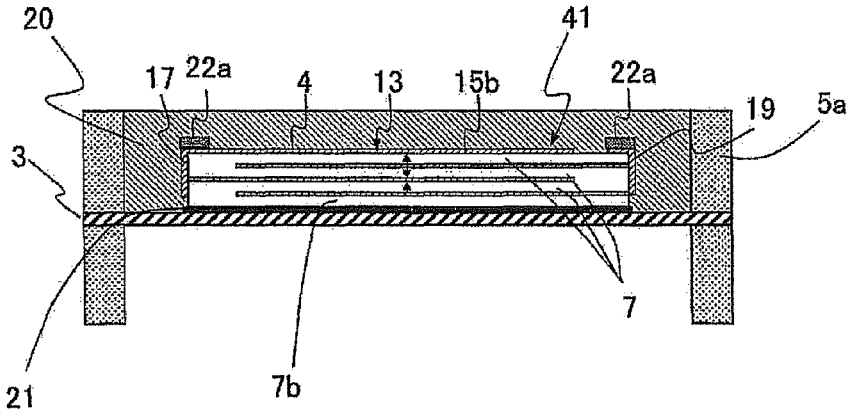
FIG. 5 is a longitudinal cross-sectional view illustrating an acoustic generator according to a fourth embodiment in which a unimorph type multilayer piezoelectric element is disposed on the top surface of a film.

FIG. 5 is a diagram illustrating an acoustic generator according to a fourth embodiment. In the fourth embodiment, a multilayer piezoelectric element 41 is bonded to only the top surface of the film 3 with the adhesive 21, and the multilayer piezoelectric element 41 is embedded with the resin layer 20.

The multilayer piezoelectric element 41 shown in FIG. 5 is a unimorph type multilayer piezoelectric element 41. That is, the unimorph type multilayer piezoelectric element is different from the multilayer piezoelectric elements 1 shown in FIGS. 2 and 3, in that the surface electrode layer 15*a* is not formed on the bottom surface of the stacked body 13 and only the surface electrode layer 15*b* is formed.

In such a multilayer piezoelectric element 41, since the first piezoelectric layer 7 from the film 3 is not sandwiched between electrodes, it does not contract nor expand and serves as a piezoelectric-deactivated layer 7*b*. The second to fourth piezoelectric layers 7 from the film 3 are configured to simultaneously contract and expand, the multilayer piezoelectric element 41 itself vibrates due to the presence of the first deactivated layer 7*b* as a deactivated layer from the film 3, and this vibration causes the surface of the resin layer 20 to vibrate.

In such an acoustic generator, similarly to the first and second embodiments, it is possible to obtain deflection flexural vibration of a wavelength corresponding to a high-frequency sound, to achieve an effect of reproducing a high-frequency sound, and to simplify the structure because the multilayer piezoelectric element 41 is disposed on only one side of the film 3. From the viewpoint of realization of a high sound pressure based on large flexural vibration, the bimorph type can be preferably used.

FIG. 6 is a diagram illustrating an acoustic generator according to a fifth embodiment. In the fifth embodiment, three multilayer piezoelectric elements 1 shown in FIGS. 2 and 3 are disposed on each of the top and bottom surfaces of the film 3 so as to be opposite to each other with the film 3 sandwiched therebetween, and these multilayer piezoelectric elements 1 are embedded with the resin layer 20.

A lead terminal 22*a* extends over the multilayer piezoelectric elements 1 on the top and bottom surfaces of the film 3 so as to connect the bent external electrodes 19*a*, one end of a lead terminal 22*b* is connected to one bent external electrode 19*a* to which the lead terminal 22*a* is connected, and the other end thereof extends to the outside. A lead terminal 22*a* extends over the surface electrode 15*b* connected to the external electrode 17, one end of the lead terminal 22*b* is connected to one surface electrode 15*b* to which the lead terminal 22*a* is connected, and the other end thereof extends to the outside.

In such an acoustic generator, similarly to the first and second embodiments, it is possible to obtain deflection flexural vibration of a wavelength corresponding to a high-frequency sound. Due to the influence of mutual interference between the multilayer piezoelectric elements 1, it is possible to suppress the vibration inducing a peak dip. Since the number of multilayer piezoelectric elements 1 is large in the fifth embodiment, it is possible to obtain a higher sound pressure.

In the fifth embodiment shown in FIG. 6, the bimorph type multilayer piezoelectric element shown in FIG. 4 and the unimorph type multilayer piezoelectric element shown in FIG. 5 can be used.

FIG. 7 is a diagram illustrating an acoustic generator according to a sixth embodiment. In the sixth embodiment, four multilayer piezoelectric elements 1 shown in FIGS. 2 and 3 are disposed on each of the top surface and the bottom surface of the film 3 so as to be opposite to each other with the film 3 sandwiched therebetween. These multilayer piezoelectric elements 1 are embedded with the resin layer 20. The multilayer piezoelectric elements 1 are arranged in two rows and two columns on the top surface and the bottom surface of the film 3 and are embedded with the resin layer 20 in this state.

A lead terminal 22*a* extends over the multilayer piezoelectric elements 1 on each of the top and bottom surfaces of the film 3 so as to connect the bent external electrodes 19*a*, one end of a lead terminal 22*b* is connected to one bent external electrode 19*a* to which the lead terminal 22*a* is connected, and the other end thereof extends to the outside. A lead terminal 22*a* extends over the surface electrode 15*b* connected to the external electrode 17, one end of the lead terminal 22*b* is connected to one surface electrode 15*b* to which the lead terminal 22*a* is connected, and the other end thereof extends to the outside.

In such an acoustic generator, similarly to the first and second embodiments, it is possible to obtain deflection flexural vibration of a wavelength corresponding to a high-frequency sound. Due to the influence of mutual interference between the multilayer piezoelectric elements 1, it is possible to suppress the vibration inducing a peak dip. Since the number of multilayer piezoelectric elements 1 is large in the sixth embodiment, it is possible to obtain a higher sound pressure. In addition, the arrangement of the multilayer piezoelectric elements 1 in two rows and two columns on each of the top and bottom surfaces of the film 3 is considered as a factor for suppressing the vibration inducing a peak dip.

In the sixth embodiment shown in FIG. 7, the bimorph type multilayer piezoelectric element shown in FIG. 4 and the unimorph type multilayer piezoelectric element shown in FIG. 5 can be used. In the sixth embodiment shown in FIG. 7, the number of multilayer piezoelectric elements 1 is set to eight in total, but may be larger than eight.

Figure 8:
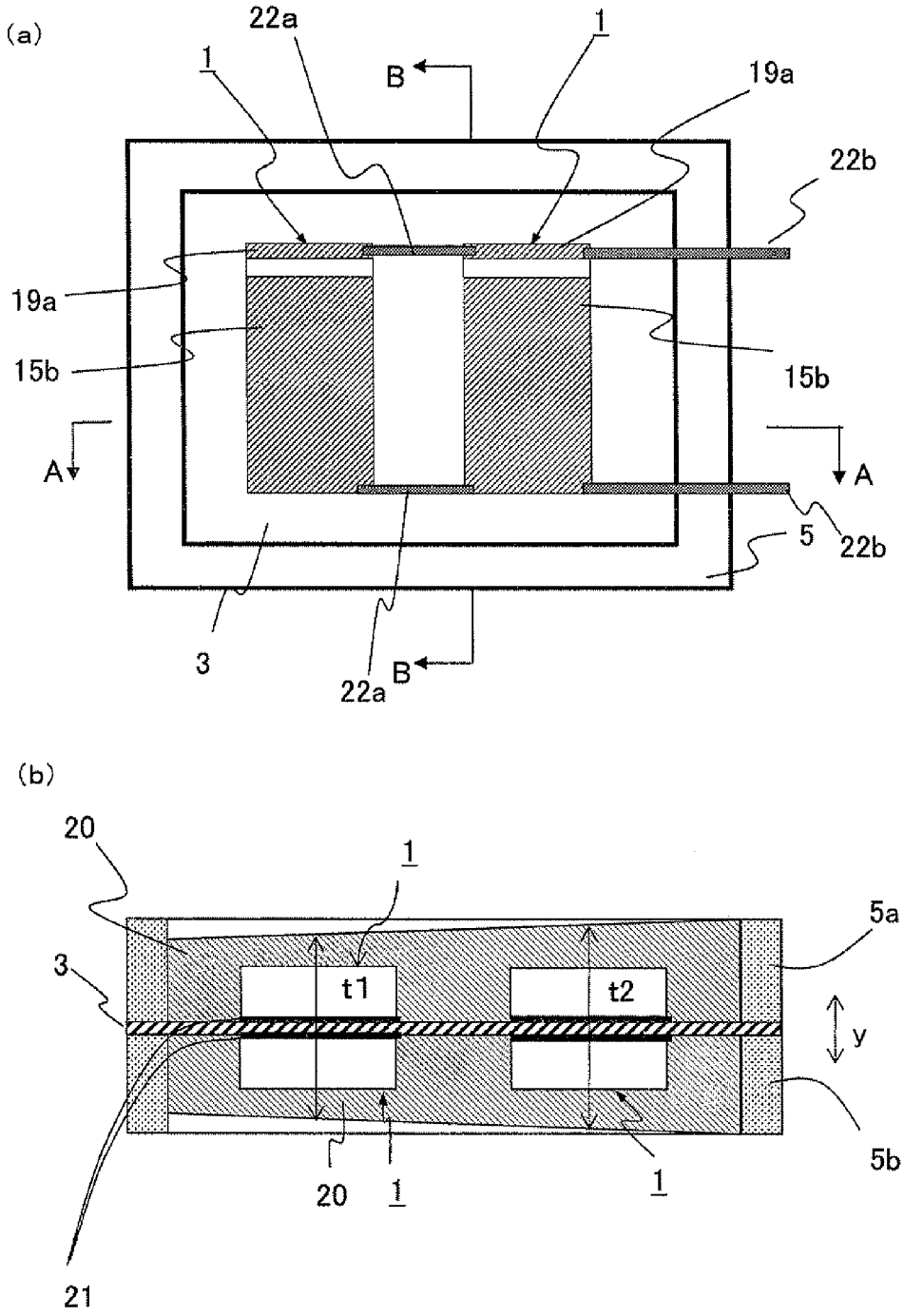
FIG. 8 is a plan view illustrating an acoustic generator according to a seventh embodiment in which two unimorph type multilayer piezoelectric elements are disposed on each of top and bottom surfaces of the resin sheet to be opposite to each other.

FIG. 8 is a diagram illustrating an acoustic generator according to a seventh embodiment. The seventh embodiment has the same configuration in shown in FIG. 1, except that the thickness of the resin layer 20 varies. Regarding the thickness of the resin layer 20, as shown in FIG. 8(*b*), the total thickness t1 of the acoustic generator in one portion where the multilayer piezoelectric elements 1 are located in the stacking direction of the piezoelectric layers 7 (hereinafter, also referred to as "in the thickness direction y of the multilayer piezoelectric element") is different from the total thickness t2 of the acoustic generator in the other portion where the multilayer piezoelectric element 1 is located in the stacking direction of the piezoelectric layer 7. In other words, the thicknesses of the resin layer 20 on the surfaces of two multilayer piezoelectric elements 1 disposed in parallel on the same surface of the film 3 are different from each other. In other words, the top and bottom surfaces of the resin layer 20 on the right side of FIG. 8(*b*) are located substantially at the same heights as the top and bottom surfaces of the frame members 5*a* and 5*b*, the top and bottom surfaces of the resin layer 20 on the left side thereof is located at heights lower than the top and bottom surfaces of the frame members 5*a* and 5*b*, and the top and bottom surfaces of the resin layer 20 are inclined about the film 3.

The total thickness t1 in the one portion where the multilayer piezoelectric elements 1 are located and the total thickness t2 in the other portion where the multilayer piezoelectric elements 1 are located have only to have a thickness difference (t2−t1>0), but the thickness difference (t2−t1) is preferably equal to or larger than 30 μm. On the other hand, from the viewpoint of transmittability (spread of a sound wave) of vibration on the top and bottom surfaces of the resin layer 20, the thickness difference (t2−t1) is preferably equal to or less than 500 μm.

In other words, the difference (t2−t1) between the total thickness t1 in the one portion where the multilayer piezoelectric elements 1 are located and the total thickness t2 in the other portion where the multilayer piezoelectric elements 1 are located is preferably equal to or more than 5% of the maximum thickness of the acoustic generator inside the frame member 5, and preferably equal to or less than 40% from the viewpoint of the spread of sound.

The total thicknesses t1 and t2 represent the total thickness of the film 3, two adhesive layers 21, two multilayer piezoelectric elements 1, and two resin layers 20 at the center of the top and bottom surfaces of the multilayer piezoelectric elements 1.

In order to form the thickness difference between the total thicknesses t1 and t2 (t2−t1>0), the thicknesses of the resin layers 20 on the top and bottom surfaces of two multilayer piezoelectric elements 1 may be made to be different from each other, or the thicknesses of the adhesive layers 21 may be made to be different from each other, or the thicknesses of the multilayer piezoelectric elements 1 may be made to be different from each other.

Figure 9:
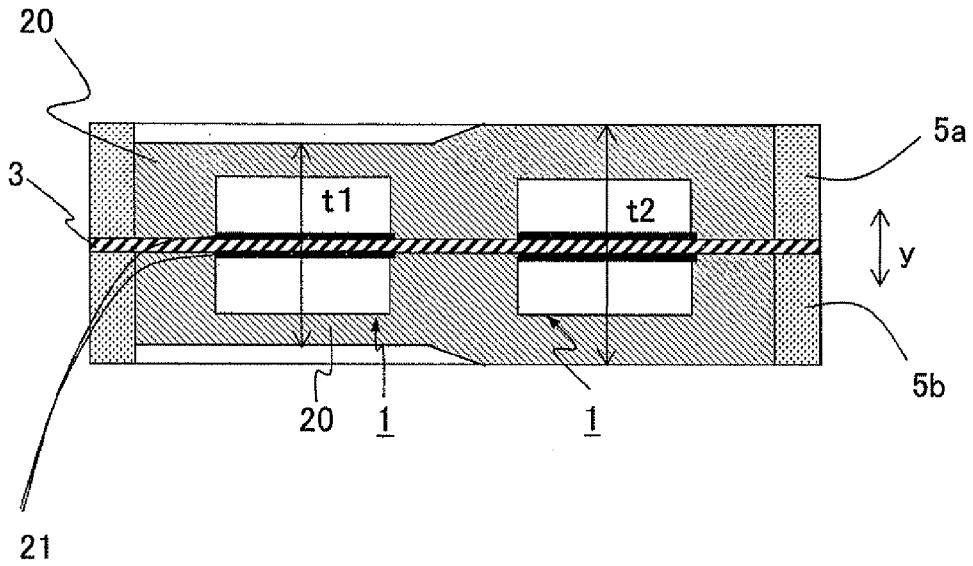
FIG. 9 is a longitudinal cross-sectional view illustrating an acoustic generator according to an eighth embodiment in which a total thickness of a piezoelectric speaker in a thickness direction of a multilayer piezoelectric element differs.

FIG. 9 is a diagram illustrating an acoustic generator according to an eighth embodiment. The eighth embodiment has the same configuration in shown in FIG. 1, except that the thickness of the resin layer 20 varies. That is, a total thickness t1 of the acoustic generator in one portion where one multilayer piezoelectric elements 1 are located in the thickness direction y of the one multilayer piezoelectric elements 1 is different from a total thickness t2 of the acoustic generator in another portion where another multilayer piezoelectric elements 1 are located in the thickness direction y of the another multilayer piezoelectric elements 1. In the eighth embodiment, the total thickness t1 of the acoustic generator in the one portion where the multilayer piezoelectric elements 1 are located is maintained in a substantially constant thickness t1 all over the top and bottom surfaces of the multilayer piezoelectric elements on one side, the total thickness t2 of the acoustic generator in the other portion where the multilayer piezoelectric elements 1 are located is maintained in a substantially constant thickness t2 all over the top and bottom surfaces of the multilayer piezoelectric elements 1 on the other side, and the thickness t1 is smaller than the thickness t2. The total thicknesses t1 and t2 of the acoustic generator in one portion and the other portion where the multilayer piezoelectric elements 1 are located have an inclination at the boundary therebetween so as not to form a stepped portion.

Such an acoustic generator can be manufactured, for example, by filling the inside of the frame member 5 with a resin so that the total thickness thereof is a thickness t1, curing the resin to maintain a constant thickness, additionally applying a resin to the other portion where the multilayer piezoelectric elements 1 are located so that the total thickness in the other portion where the multilayer piezoelectric elements 1 are located is a thickness t2, and curing the resin.

In the acoustic generators shown in FIGS. 8 and 9, the resin layer 20 embedding two multilayer piezoelectric elements 1 on the top surface of the film 3 and the resin layer 20 embedding two multilayer piezoelectric elements 1 on the bottom surface of the film 3 vibrate as a unified body. By causing the total thickness t1 in one portion where the multilayer piezoelectric elements 1 are located to be different from the total thickness t2 in the other portion where the multilayer piezoelectric elements 1 are located, the resonant frequency of the multilayer piezoelectric elements 1 on one side is not matched with the resonant frequency of the multilayer piezoelectric elements 1 on the other side and it is thus possible to suppress resonance of the plurality of multilayer piezoelectric elements 1 and to reduce occurrence of a peak dip in the acoustic generator, even when the vibration of the plurality of multilayer piezoelectric elements 1 is transmitted to the top and bottom surfaces of the resin layers 20.

Even in the second to sixth embodiments described above, by causing the total thickness t1 in one portion where the multilayer piezoelectric elements 1 are located to be different from the total thickness t2 in the other portion where the multilayer piezoelectric elements 1 are located, it is possible to further suppress resonance of the plurality of multilayer piezoelectric elements 1 and it is possible to reduce occurrence of a peak dip in the acoustic generator.

Figure 10:
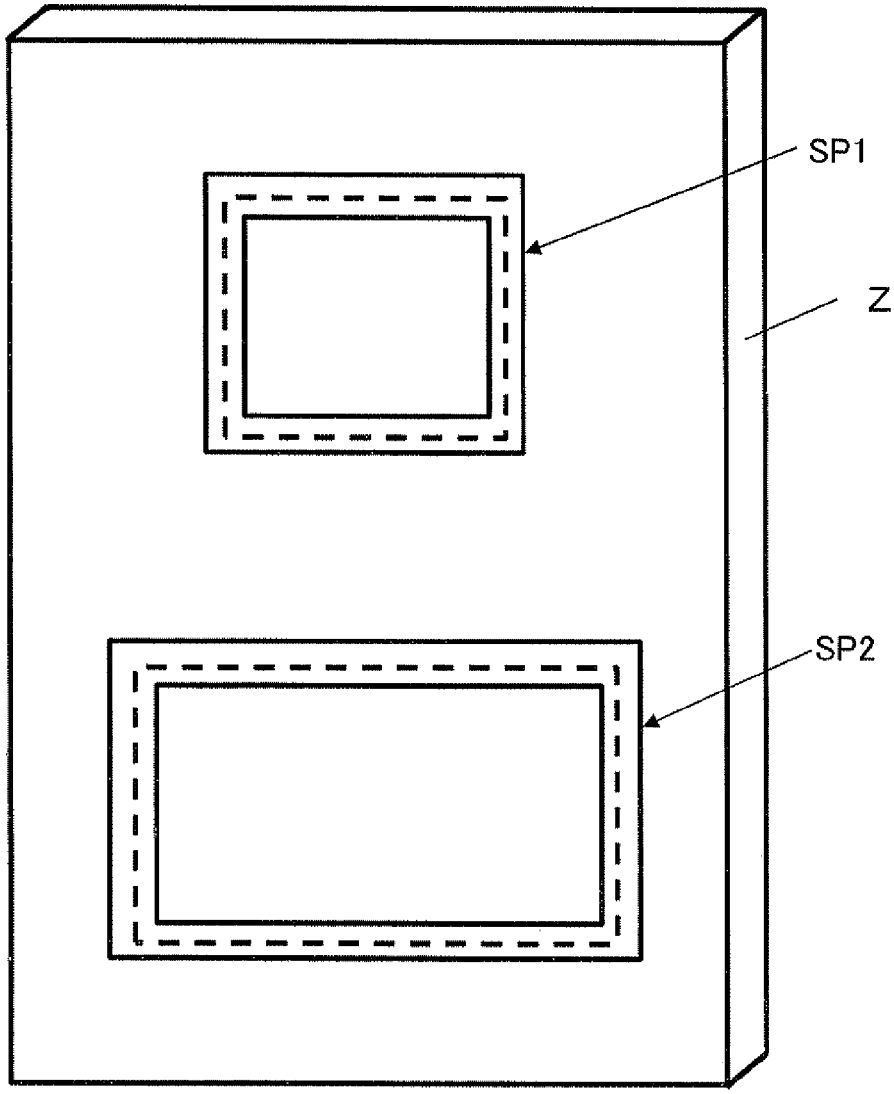
FIG. 10 is a plan view illustrating a speaker unit according to a ninth embodiment.

The acoustic generators according to the embodiments can be used as a speaker unit in combination with a low-pitched piezoelectric speaker. As shown in FIG. 10, a speaker unit according to a ninth embodiment can be constructed by fixing a high-pitched piezoelectric speaker SP1 and a low-pitched piezoelectric speaker SP2 to opening portions, which are used to receive the high-pitched piezoelectric speaker SP1 and the low-pitched piezoelectric speaker SP2, respectively, formed in a support plate Z formed of a metal plate, and employs the acoustic generator according to any one of the first to eighth embodiments as the high-pitched piezoelectric speaker SP1.

The high-pitched piezoelectric speaker SP1 mainly serves to reproduce frequencies of more than or equal to 20 KHz and the low-pitched piezoelectric speaker SP2 mainly serves to reproduce frequencies of less than or equal to 20 KHz.

The low-pitched piezoelectric speaker SP2 can employ a piezoelectric speaker that is different from the high-pitched piezoelectric speaker SP1, only in that the longest side of a rectangular shape or an elliptical shape is enlarged from the view point of easily reproducing low frequencies, but that has substantially the same configuration as the high-pitched piezoelectric speaker SP1.

In such a speaker unit, the sound of ultrahigh frequency components of more than or equal to 100 KHz can be reproduced by the use of the acoustic generator according to any one of the first to eighth embodiments which is used as the high-pitched piezoelectric speaker SP1, and can keep the sound pressure high even when such the sound of ultrahigh frequency components is emitted. Accordingly, it is possible to maintain a high sound pressure from a low-pitched sound to a high-pitched sound, for example, from about 500 Hz to ultrahigh frequencies of more than or equal to 100 KHz and to suppress occurrence of a large peak dip.

Example 1

Piezoelectric powder including lead zirconate titanate (PZT) in which a part of Zr is replaced with Sb, a binder, a dispersant, a plasticizer, and a solvent were kneaded through ball mill mixture for 24 hours to prepare slurry.

A green sheet was prepared using the resultant slurry through the use of a doctor blade method. Electrode paste including Ag and Pd as an electrode material was applied to the green sheet in a predetermined shape through the use of screen printing, three green sheets having the electrode paste applied thereto were stacked, a green sheet not having the electrode paste applied thereto was stacked as the outermost layer thereof, and the resultant was pressurized to prepare a laminated molded body. The laminated molded body was degreased in the atmosphere at 500° C. for 1 hour, and then was fired in the atmosphere at 1100° C. for 3 hours, whereby a stacked body was obtained.

Then, both end portions in the length direction x of the obtained stacked body were cut through the use of a dicing process, ends of the internal electrode layers were exposed from the side faces, in order to form the surface electrode layers on both main surfaces of the stacked body, electrode paste including Ag and glass as the electrode material was applied to one main surface of the piezoelectric body through the use of a screen printing method, then electrode paste including Ag and glass as the external electrode material was applied to both side faces thereof in the length direction x through the use of a dipping method, and the resultant was backed in the atmosphere at 700° C. for 10 minutes, whereby the multilayer piezoelectric element was manufactured as shown in FIG. 2.

Regarding the dimension, the main surface of the manufactured stacked body had a width of 5 mm, a length of 15 mm, and a thickness of 100 μm.

Then, a voltage of 100 V was applied between the internal electrode layers and between the internal electrode layers and the surface electrodes via the external electrodes of the multilayer piezoelectric element for 2 minutes to perform the polarization, whereby a unimorph type multilayer piezoelectric element was obtained.

A film formed of a polyimide resin with a thickness of 25 μm was prepared, this film was fixed to the frame member with tension applied thereto, an adhesive formed of an acryl resin was applied to both main surfaces of the fixed film, the multilayer piezoelectric elements were pressed against portions of the film having the adhesive applied thereto from both sides so as to sandwich the film therebetween, and the adhesive was cured in air at 120° C. for 1 hour, whereby an adhesive layer with a thickness of 5 μm was formed. Regarding the dimension, the film in the frame member had a longitudinal length of 28 mm and a transverse length of 21 mm, and the gap between two multilayer piezoelectric elements was 2 mm. The multilayer piezoelectric elements were bonded to the film so that the gap between the multilayer piezoelectric elements and the frame member is constant. Thereafter, lead terminals were bonded to the two multilayer piezoelectric elements and a pair of lead terminals was drawn to the outside.

An acryl-based resin with a Young's modulus of 17 MPa after the curing was made to flow in the frame member, the acryl-based resin was filled to form the same height as the height of the frame member, the multilayer piezoelectric elements and the lead terminals other than the lead terminals drawn to the outside were embedded, and the resin was cured, whereby the acoustic generator shown in FIG. 2 was manufactured.

The sound pressure and frequency characteristics of the manufactured acoustic generator were evaluated on the basis of JEITA (Standard of Japan Electronics and Information Technology Industries Association) EIJA RC-8124A. The sound pressure was evaluated by inputting a sinusoidal signal of 1 W (resistance of 8Ω) to the lead terminals of the multilayer piezoelectric elements of the acoustic generator and installing a microphone at a point apart by 1 m from the acoustic generator on the reference axis thereof. The measurement results are shown in FIG. 11.

Figure 11:
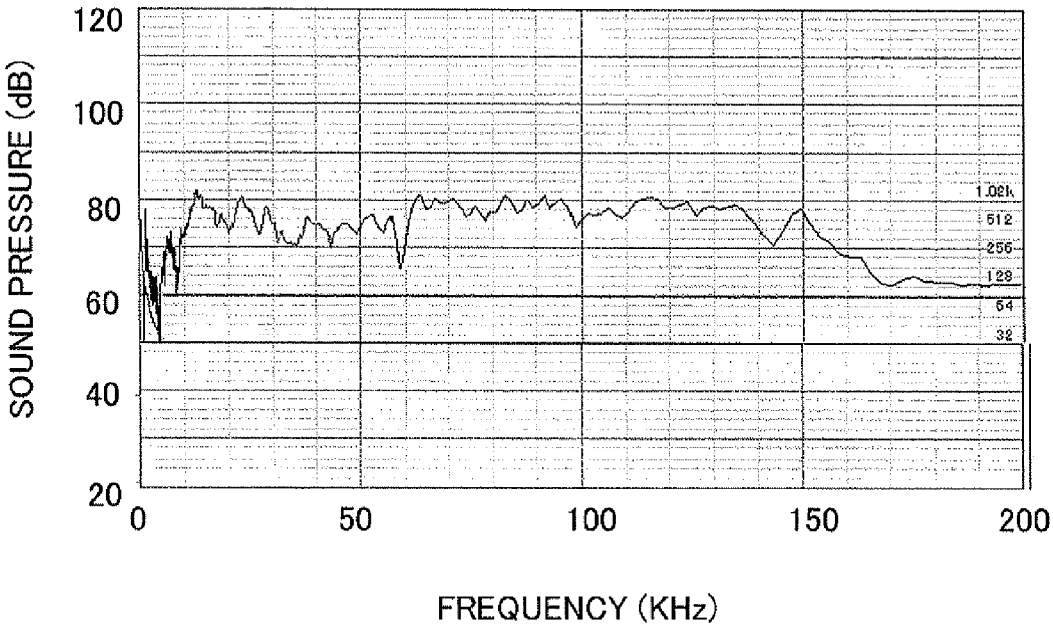
FIG. 11 is a graph illustrating frequency dependency of a sound pressure in the acoustic generator shown in FIG. 2.

It could be seen from FIG. 11 that a high sound pressure of about 78 dB and a small peak dip characteristic up to 20 to 150 KHz is obtained from the acoustic generator according to the first embodiment shown in FIG. 2. Particularly, it could be seen that a high sound pressure of about 80 dB is obtained in the range of 60 to 130 KHz, a large peak dip does not occur, and substantially flat sound pressure characteristics are obtained. It could be also seen that a high sound pressure of 60 dB or higher is obtained in a broad range of 10 to 200 KHz.

Example 1 shows an example where a unimorph type multilayer piezoelectric element is used as a piezoelectric element, but the same tendency appeared even when a bimorph type multilayer piezoelectric element was used.

Example 2

Similarly to Example 1, as shown in FIG. 7, an acoustic generator having four multilayer piezoelectric elements on each of both surfaces of a film was manufactured using unimorph type multilayer piezoelectric elements and sound pressure and frequency characteristics were measured. The results are shown in FIG. 12.

Figure 12:
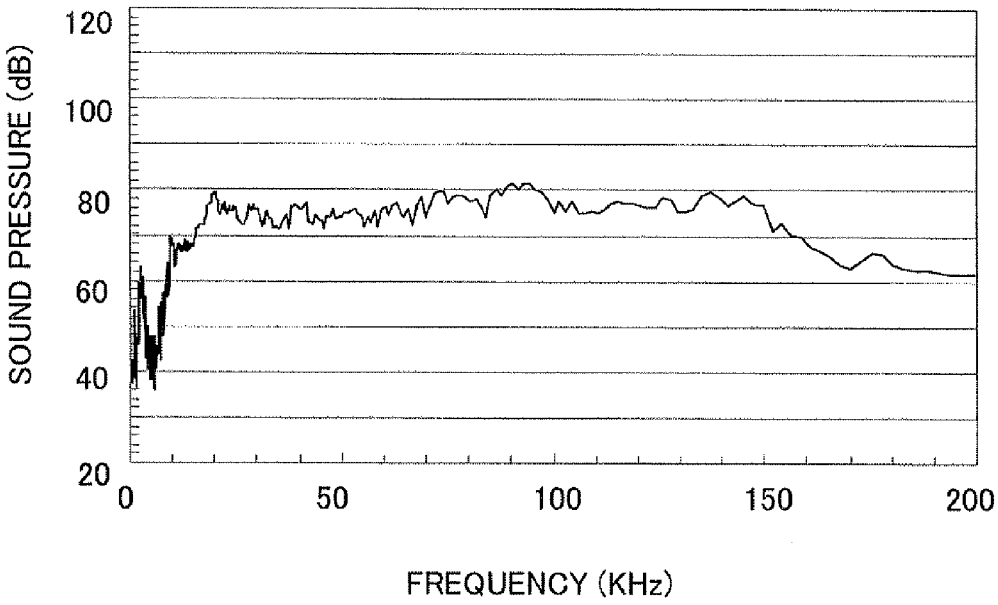
FIG. 12 is a graph illustrating frequency dependency of a sound pressure in the acoustic generator shown in FIG. 7.

It could be seen from FIG. 12 that a high sound pressure of about 78 dB and a sound pressure with a small peak dip up to 20 to 150 KHz are obtained and that the peak dip in an ultrahigh frequency band broader than that in Example 1 can be reduced.

REFERENCE SIGNS LIST

1, 31, 41: Multilayer piezoelectric element
3: Film
5: Frame member
5*a*: First frame member
5*b*: Second frame member
7: Piezoelectric layer
9: Internal electrode layer
13: Stacked body

15, 15*a*, 15*b*: Surface electrode layer
17, 19: External electrode layer
20: Resin layer
X: Length direction x of Stacked body
Y: Thickness direction y of Stacked body

The invention claimed is:

1. An acoustic generator, comprising:
a film;
a frame member disposed on an outer peripheral edge of the film;
a plurality of piezoelectric elements disposed on the film and inside the frame member; and
a resin layer disposed inside the frame member so as to cover the piezoelectrics elements,
wherein a total thickness of a first piezoelectric element, a part of the film on which the first piezoelectric element is disposed, and a part of the resin layer on which the first piezoelectric element is disposed, is different from a total thickness of a second piezoelectric element, a part of the film on which the second piezoelectric element is disposed, and a part of the resin layer on which the second piezoelectric element is disposed.

2. The acoustic generator according to claim 1, wherein the frame member is formed of a material less deformable than the resin layer, and the resin layer is bonded to the frame member.

3. The acoustic generator according to claim 1, wherein the resin layer is formed of a resin having a Young's modulus of 1 MPa to 1 GPa.

4. The acoustic generator according claim 1, wherein the resin is formed of an acryl-based resin.

5. The acoustic generator according to claim 1, wherein the film is formed of a resin.

6. The acoustic generator according to claim 1, wherein the plurality of piezoelectric elements are bimorph multilayer piezoelectric elements.

7. The acoustic generator according to claim 1, wherein the plurality of piezoelectric elements are bimorph multilayer piezoelectric elements.

8. The acoustic generator according to claim 1, wherein the frame member includes a first frame member and a second frame member, and the outer peripheral edge of the film is sandwiched between the first frame member and the second frame member.

9. The acoustic generator according to claim 8, wherein the plurality of piezoelectric elements are disposed on both surfaces of the film so as to be opposite to each other with the film sandwiched therebetween.

10. The acoustic generator according to claim 9, wherein the plurality of the piezoelectric elements are disposed on the film and inside the first frame member and the second frame member.

11. The acoustic generator according to claim 1, wherein piezoelectric elements disposed on a same surface of the film are supplied with a same voltage.

12. A speaker unit, comprising:
a high-pitched piezoelectric speaker;
a low-pitched piezoelectric speaker; and
a support diaphragm configured to fix the high-pitched piezoelectric speaker and the low-pitched piezoelectric speaker,
the high-pitched piezoelectric speaker being constructed by the acoustic generator according to claim 1.

13. The speaker unit according to claim 12, wherein piezoelectric elements disposed on a same surface of the film are supplied with a same voltage.

* * * * *